US008675899B2

(12) United States Patent
Jung

(10) Patent No.: US 8,675,899 B2
(45) Date of Patent: Mar. 18, 2014

(54) FRONT SURROUND SYSTEM AND METHOD FOR PROCESSING SIGNAL USING SPEAKER ARRAY

(75) Inventor: Chi-ho Jung, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1272 days.

(21) Appl. No.: 11/839,011

(22) Filed: Aug. 15, 2007

(65) Prior Publication Data

US 2008/0181416 A1 Jul. 31, 2008

(30) Foreign Application Priority Data

Jan. 31, 2007 (KR) ..... 10-2007-0010122

(51) Int. Cl.
*H04R 5/00* (2006.01)

(52) U.S. Cl.
USPC ..... 381/307; 381/2; 381/303; 381/304; 381/305; 381/306; 381/308; 381/309; 381/310; 381/17; 381/18; 381/19; 381/99; 381/152; 381/182

(58) Field of Classification Search
USPC ..... 381/303–310, 56–59, 111, 24, 300, 381/335, 17–19, 27
See application file for complete search history.

(56) References Cited

U.S. PATENT DOCUMENTS 441,577 A * 11/1890 Kurihara ..... 24/41.1
5,717,766 A * 2/1998 Azoulay et al. ..... 381/300
5,751,821 A * 5/1998 Smith ..... 381/332
5,850,457 A * 12/1998 Gefvert ..... 381/300
5,870,484 A * 2/1999 Greenberger ..... 381/300
5,953,432 A 9/1999 Yanagawa et al.
6,625,289 B1 * 9/2003 Oliemuller ..... 381/182
7,426,278 B2 * 9/2008 Meynial ..... 381/82
7,515,719 B2 * 4/2009 Hooley et al. ..... 381/18
7,920,710 B2 * 4/2011 Konagai et al. ..... 381/111

(Continued)

FOREIGN PATENT DOCUMENTS

JP 06-205496 7/1994
JP 2003-23689 1/2003

(Continued)

OTHER PUBLICATIONS

Niro, Niro 1000/800/620/420 Owner Manual,2004-2006,.*
Korean Notice of Allowance dated May 9, 2013 issued in KR Application No. 10-2007-0010122.

*Primary Examiner* — Davetta W Goins
*Assistant Examiner* — Kuassi Ganmavo
(74) *Attorney, Agent, or Firm* — Stanzione & Kim, LLP

(57) ABSTRACT

A front surround sound reproduction system which improves the performance of beam steering by using a speaker array arranged geometrically on two or more planes or on one curved surface, and a signal reproducing method of the system. The audio reproduction apparatus to reproduce a multi-channel audio signal by using a plurality of speakers includes a signal distribution unit to duplicate a multi-channel audio signal and to distribute the duplicated signals as one or more groups of multi-channel signals corresponding to one or more speaker array groups, a steering processing unit to form sound beams with steering angles predetermined in relation to each speaker array group, from the groups of multi-channel signals distributed by the signal distribution unit, and a speaker array unit having one or more speaker array groups to reproduce the sound beams of each group formed by the steering processing unit, in the speaker array group.

28 Claims, 9 Drawing Sheets

(56) References Cited

U.S. PATENT DOCUMENTS

| | | | | |
|---|---|---|---|---|
| 8,135,158 | B2 * | 3/2012 | Fincham | 381/387 |
| 2004/0240697 | A1 * | 12/2004 | Keele, Jr. | 381/336 |
| 2005/0041530 | A1 * | 2/2005 | Goudie et al. | 367/138 |
| 2005/0180577 | A1 * | 8/2005 | Horbach | 381/27 |
| 2006/0126878 | A1 * | 6/2006 | Takumai et al. | 381/335 |
| 2007/0019816 | A1 * | 1/2007 | Konagai | 381/59 |
| 2008/0165979 | A1 * | 7/2008 | Takumai | 381/59 |
| 2009/0225991 | A1 * | 9/2009 | Oh et al. | 381/17 |
| 2011/0013778 | A1 | 1/2011 | Takumai | |
| 2013/0142337 | A1 | 6/2013 | Troughton et al. | |

FOREIGN PATENT DOCUMENTS

| | | | | |
|---|---|---|---|---|
| JP | 2003-235092 | * | 8/2003 | H04R 3/12 |
| JP | 2006013711 | | 1/2006 | |
| JP | 2006319390 | | 11/2006 | |
| KR | 1020020059600 | | 7/2002 | |
| KR | 2006-52666 | | 5/2006 | |
| WO | 2004-075601 | | 9/2004 | |

* cited by examiner

FRONT SURROUND SYSTEM AND METHOD FOR PROCESSING SIGNAL USING SPEAKER ARRAY

CROSS-REFERENCE TO RELATED APPLICATIONS

This application claims the benefit of Korean Patent Application No. 10-2007-0010122, filed on Jan. 31, 2007, in the Korean Intellectual Property Office, the disclosure of which is incorporated herein in its entirety and by reference.

BACKGROUND OF THE INVENTION

1. Field of the Invention

The present general inventive concept relates to a front surround sound reproduction system using a speaker array, and more particularly, to a front surround sound reproduction system improving the performance of beam steering by using a speaker array which is arranged geometrically on two or more planes or on one curved surface, and a signal reproducing method for the system.

2. Description of the Related Art

In general, a front surround sound reproduction system utilizes sound projection technology, thereby generating a stereo effect by using a speaker array on a front surface without side or back speakers.

The front surround sound reproduction system uses the speaker array to generate a sound beam from a surround channel signal, and by steering the sound beam 30 degrees or more, generates a stereo effect through wall reflection. Accordingly, due to the reflected sound, a listener feels a stereo effect as if the sound came from side and back speakers.

Technology related to this front surround sound reproduction system is disclosed in WO 04/075601, filed Sep. 2, 2004, entitled "A Sound Beam Loudspeaker System".

FIG. 1 is a diagram illustrating a front surface part 100 of a speaker of a conventional front surround sound reproduction system.

The front surface part 100 of the speaker includes a speaker array 111 reproducing a high frequency signal and a woofer 112 reproducing mid and low frequency signals.

Accordingly, the front surround sound reproduction system divides an input surround channel signal into a high frequency signal and a mid and low frequency signal, and provides the high frequency signal to the beam forming speaker array 111, and the mid and low frequency signal to the woofer 112.

The speaker array having one plane as illustrated in FIG. 1 forms a beam which can be twisted at a variety of steering angles in relation to the front of a listener when a signal of each channel is generated. In this case, the steering angle is the angle between a vector perpendicular to the speaker array surface and the directional vector of the beam. For example, as illustrated in FIG. 1, the speaker array on one plane generates a center channel (C) beam twisted by 0 degrees, a left surround channel (Ls) and a right surround channel (Rs) beams twisted by 30 degrees, and a left front channel (L) and a right front channel (R) with beams twisted by 60 degrees. However, when a beam is projected at an angle of 30 degrees or more, it generally has a lowered sharpness. Thus, if the steering angle of a sound beam increases, the effective aperture of a speaker array decreases, thereby lowering the beam performance.

According to conventional technology, when a surround channel signal is reproduced in the speaker array structure, the projected beam is twisted by 70-80 degrees. Thus, the quality of the beam is lowered and it fails to provide the intended stereo sound effect.

SUMMARY OF THE INVENTION

The present general inventive concept provides a front surround sound reproduction system which improves the performance of beam steering by using a speaker array arranged geometrically on two or more planes or on one curved surface, and a signal reproducing method for the system.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a front surround sound reproduction system in an audio reproduction apparatus for reproducing multi-channel audio signals by using a plurality of speakers, the system including: a signal distribution unit duplicating a multi-channel audio signal and distributing the duplicated signals as one or more groups of multi-channel signals corresponding to one or more speaker array groups, a steering processing unit forming sound beams with steering angles predetermined in relation to each speaker array group, from the groups of multi-channel signals distributed by the signal distribution unit, and a speaker array unit having one or more speaker array groups, and reproducing the sound beams of each group formed by the steering processing unit, in the speaker array group.

The foregoing and/or other aspects and utilities of the present general inventive concept may also be achieved by providing a method of reproducing multi-channel audio signals in a front surround system by using a plurality of speakers, the method including duplicating a multi-channel audio signal and distributing the duplicated signals as one or more groups of multi-channel signals corresponding to one or more speaker array groups, forming sound beams with steering angles predetermined in relation to each speaker array group, from the groups of multi-channel signals distributed by the signal distribution unit, and reproducing the sound beams of each group formed by the steering processing unit, in the speaker array group.

The foregoing and/or other aspects and utilities of the present general inventive concept may also be achieved by providing a surround sound reproduction system, the system comprising a first speaker array having a plurality of first speakers arranged on a first plane to correspond to a plurality of first channel signals, and a second speaker array having a plurality of second speakers, arranged on a second plane which is at an angle with respect to the first plane, to correspond to a plurality of second channel signals.

The foregoing and/or other aspects and utilities of the present general inventive concept may also be achieved by providing a surround sound reproduction system, the system comprising a steering processing unit to process a plurality of first channel signals and a plurality of second channel signals, to correspond to a first speaker array having a first plurality of speakers and a second speaker array having a second plurality of speakers, and to arrange the first speaker array and second speaker array at angles to each other.

The foregoing and/or other aspects and utilities of the present general inventive concept may also be achieved by providing surround sound reproduction system, the system comprising a first speaker array having a plurality of first speakers arranged on a first plane to correspond to a plurality of first channel signals, and a second speaker array having a plurality of second speakers, arranged on a second plane which is at an angle with respect to the first plane, to correspond to a plurality of second channel signals, and a steering processing unit to process the plurality of first channel signals and the plurality of second channel signals.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
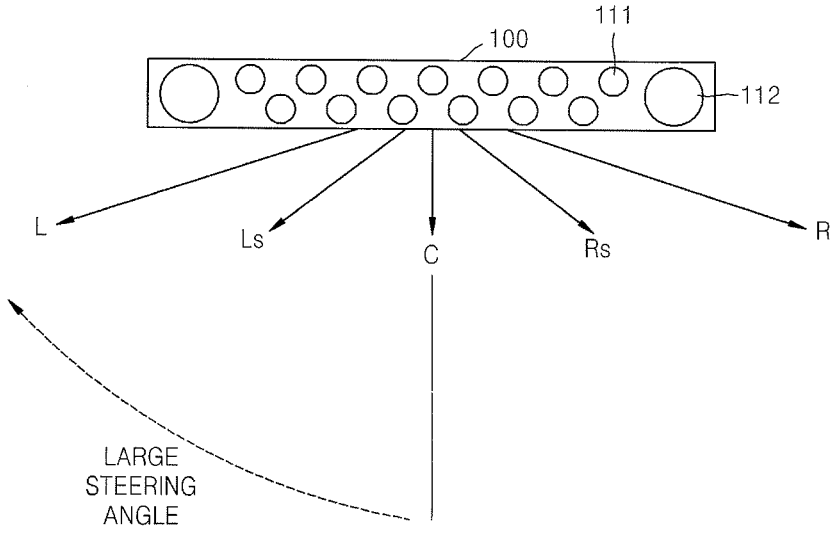
FIG. 1 (PRIOR ART)
FIG. 1 is a diagram illustrating a front surface part of a speaker of a conventional front surround sound reproduction system.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
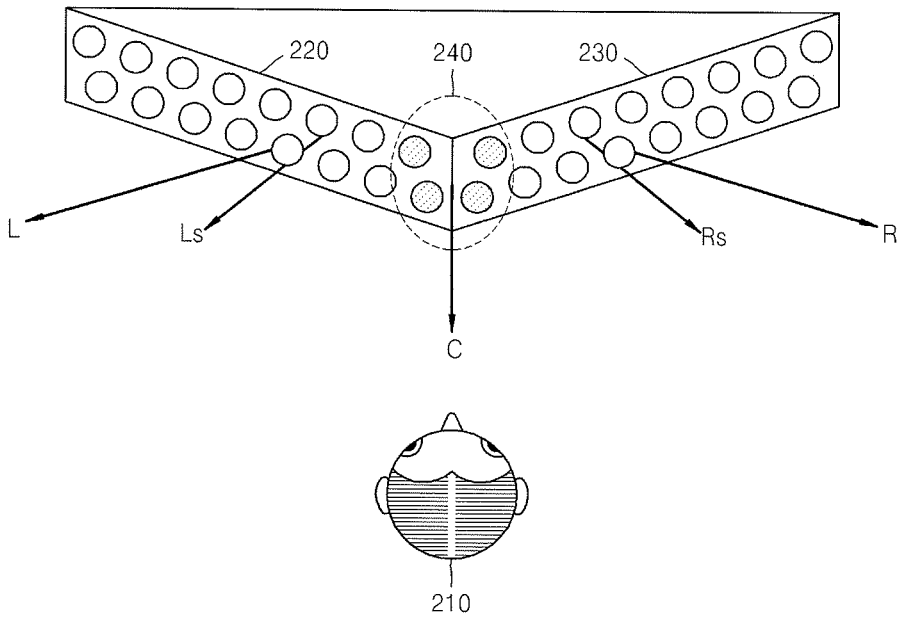
FIG. 2 is a diagram illustrating an arrangement of two speaker array groups in a front surround system according to an embodiment of the present general inventive concept.

FIG. 2 is a diagram illustrating an arrangement of two speaker array groups in a front surround system according to an embodiment of the present general inventive concept.

The speaker array structure illustrated in FIG. 2 is formed of two speaker array groups having two planes. Each speaker array group is disposed on a different plane. A left speaker array surface 220 and a right speaker array surface 230 are connected to each other at an angle in order to minimize steering angles. In relation to a listener 210, the left speaker array surface 220 reproduces signals of a left channel, for example, a front left channel (L), and a left surround channel (Ls), and the right speaker array surface 230 reproduces signals of a right channel, for example, a front right channel (R), and a right surround channel (Rs). Also, speakers 240 near the boundary between the left speaker array surface 220 and the right speaker array surface 230 reproduce signals of a center channel (C) directed to the front of the listener 210. The left speaker array surface 220 and the right speaker array surface 230 include a left low frequency band speaker (not shown) and a right low frequency band speaker, respectively. The two planes may be discontinuous planes, may not be parallel to each other, or may form an angle therebetween other than 180 degrees.

Figure 3:
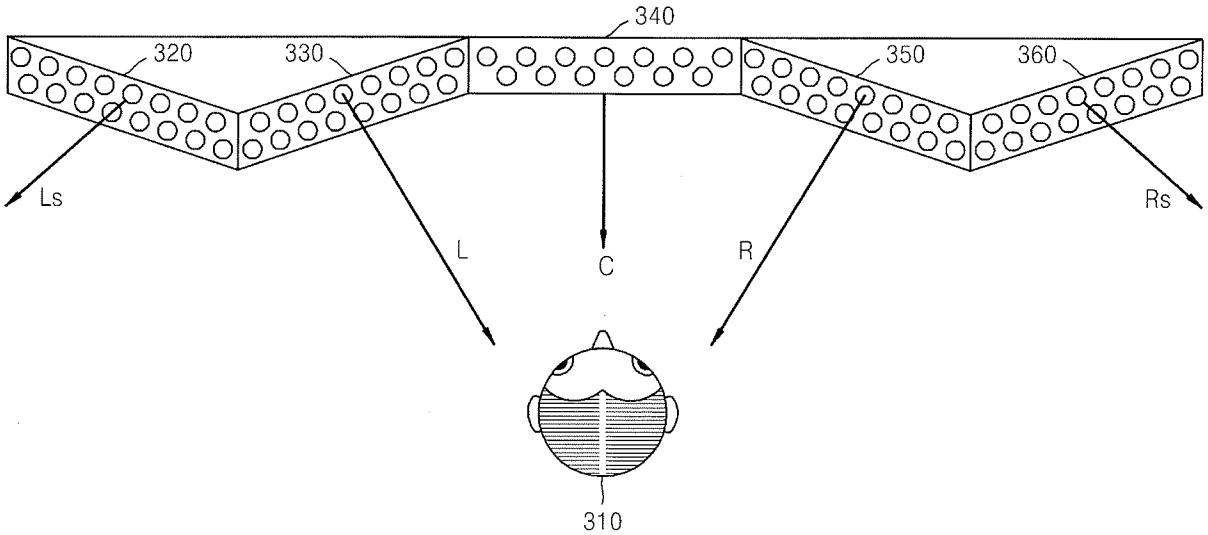
FIG. 3 is a diagram illustrating an arrangement of five speaker array groups in a front surround system according to an embodiment of the general inventive concept.

FIG. 3 is a diagram illustrating an arrangement of five speaker array groups in a front surround system according to an embodiment of the present general inventive concept.

The speaker array structure illustrated in FIG. 3 is formed of five speaker array groups having five discontinuous planes. Each speaker array group is disposed on a different plane. In addition, some of the speaker array groups can have intersecting or parallel planes. Five speaker array surfaces 320, 330, 340, 350, and 360 are connected to each other at an angle in order to minimize steering angles. For example, in relation to a listener 310, a first speaker array surface 320 reproduces signals of a left surround channel (Ls), a second speaker array surface 330 reproduces signals of a left surround front left channel (L), a third speaker array surface 340 reproduces signals of a center channel (C) directed to the listener 310, a fourth speaker array surface 350 reproduces signals of a right surround front right channel (R), and a fifth speaker array surface 360 reproduces signals of a right surround channel (Rs).

Also, in FIG. 3 the speaker array structure having a plurality of speaker array surfaces is arranged at an angle in which sound is directly transferred to the listener 310 without using wall reflection via the speaker array reproducing the center channel (C).

Each speaker array surface further includes left and right low frequency band speakers (not shown) reproducing mid and low frequency signals. The speaker array surface 340 may be disposed on a plane having angles with other speaker array surfaces 320, 330, 350, and 360. The other speaker array surfaces 320, 330, 350, and 360 may be disposed symmetrically with respect to speaker array surface 340.

Figure 4:
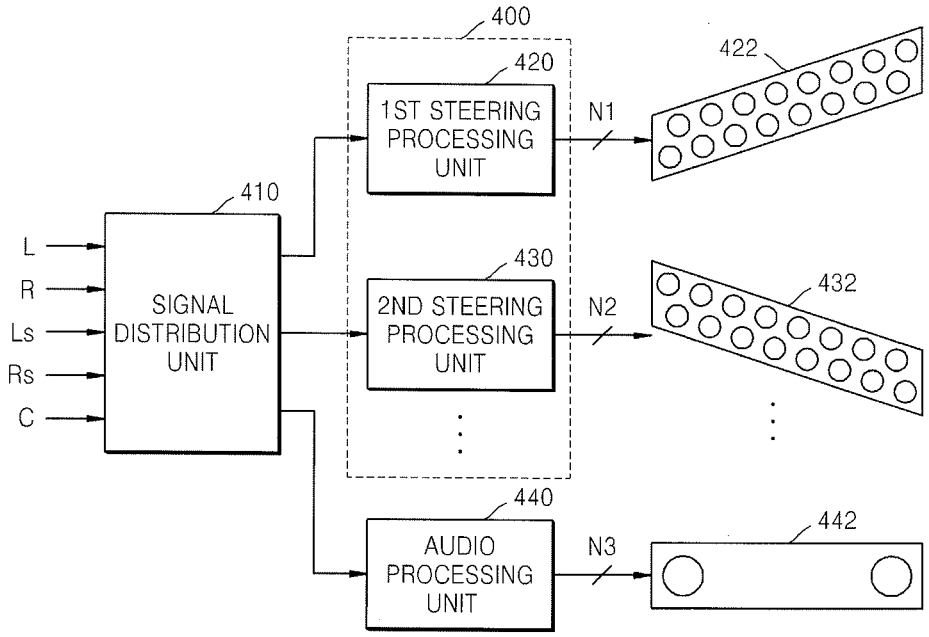
FIG. 4 is a block diagram illustrating a front surround system having a multi-plane speaker array according to an embodiment of the present general inventive concept.

FIG. 4 is a block diagram illustrating a front surround system having a multi-plane speaker array according to an embodiment of the present general inventive concept.

The front surround system illustrated in FIG. 4 is composed of a signal distribution unit 410, a steering processing unit 400, an audio processing unit 440, a first high frequency band speaker array group 422, a second high frequency band speaker array group 432, and a low frequency band speaker 442. The steering processing unit 400 is composed of a first steering processing unit 420 and a second steering processing unit 430 corresponding respectively to the first and second high frequency band speaker array groups 422 and 432.

First, pulse coded modulation (PCM) audio signals of 5 channels, i.e. a front left channel (L), a front right channel (R), a center channel (C), a left surround channel (Ls), and a right surround channel (Rs), are input. In the current embodiment, five channels are used as an example, but it is clear to those skilled in the art that the current embodiment can be applied to additional multiple channel configurations, such as 6.1 channels, 7.1 channels, etc. Also, it is difficult for a low frequency effect (LFE) channel signal to be directed due to its physical characteristics, and the LFE channel signal may damage a high frequency speaker. Accordingly, beam forming processing is not performed on the LFE channel signal.

In FIG. 4, the signal distribution unit 410 duplicates the input multi-channel signals, i.e. the 5-channel PCM audio signals, and distributes the duplicated signals as a plurality of multi-channel signals (e.g. 5 channels+5 channels+ . . . ) each corresponding to a high frequency band speaker array group. In this case, for the duplication circuit, technology such as a resistor array or buffers can be used.

The steering processing unit 400 generates sound beams from at least one group of multi-channel signals distributed from the signal distribution unit 410, by using a steering angle predetermined to suit each speaker array group. For example, the first steering processing unit 420 generates sound beams (N1) from a first group of multi-channel signals distributed in the signal distribution unit 410, by using a steering angle predetermined for the first high frequency band speaker array group 422. The second steering processing unit 430 generates sound beams (N2) from a second group of multi-channel signals distributed in the signal distribution unit 410, by using a steering angle predetermined for the second high frequency band speaker array group 432.

In FIG. 4, the audio processing unit 440 processes another group of multi-channel signals distributed in the signal distribution unit 410 through virtual sound processing and downmixing in order to make audio signals for low frequency band speakers 442. In this case, the 5-channel PCM audio signals are not generated as sound beams, but are provided to the low frequency band speakers 442 through virtual sound processing and downmixing. The steering processing unit 400 processes the different frequency bands corresponding to the speaker arrays 422, 432, and 442 with different factors according to arrangement of the speaker arrays with respect to each other, for example, angles formed therebetween.

Figure 5:
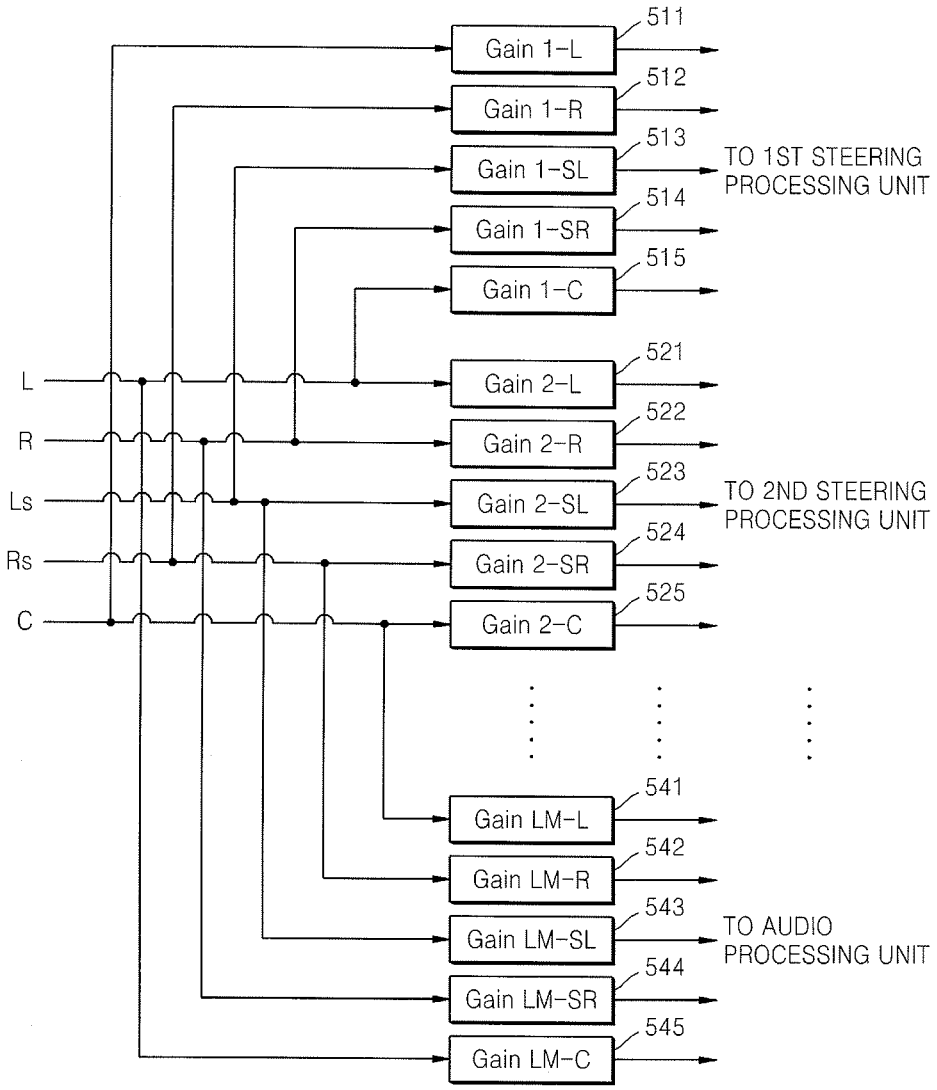
FIG. 5 is a diagram illustrating a signal distribution unit illustrated in FIG. 4 according to an embodiment of the present general inventive concept.

FIG. 5 is a diagram illustrating the signal distribution unit 410 illustrated in FIG. 4 according to an embodiment of the present general inventive concept.

Referring to FIG. 5, the signals of the front left channel (L), the front right channel (R), the center channel (C), the left surround channel (Ls), the right surround channel (Rs) are separated into a first group of 5-channel signals for the first high frequency band speaker array group 422, and a second group of 5-channel signals for the second high frequency band speaker array group 432 having amplification values of a first group of amplifiers 511 through 515 and a second group of amplifiers 521 through 525, respectively. In this case, the amplification values of the first group of amplifiers 511 through 515 are Gain 1-L, Gain 1-R, Gain 1-SL, Gain 1-SR, and Gain 1-C, respectively, while the amplification values of the second group of amplifiers 521 through 525 are Gain 2-L, Gain 2-R, Gain 2-SL, Gain 2-SR, and Gain 2-C, respectively. For example, Gain 2-SL is the amplification value to be applied to the left surround channel (Ls) signal to be provided to the second high frequency band speaker array group 432.

In addition, in FIG. 5 the signals of the front left channel (L), the front right channel (R), the center channel (C), the left surround channel (Ls), and the right surround channel (Rs) are separated into multi-channel signals for the low frequency band speakers 442 through a third group of amplifiers 541 through 545.

In this case, FIG. 5 illustrates the amplification values of the third group of amplifiers 541 through 545 are Gain LM-L, Gain LM-R, Gain LM-SL, Gain LM-SR, Gain LM-C, respectively. The amplification values for the amplifiers of each group are applied differently with respect to each speaker array group, and when the values are determined, the number of speakers and angles of each speaker array group are also considered.

Figure 6:
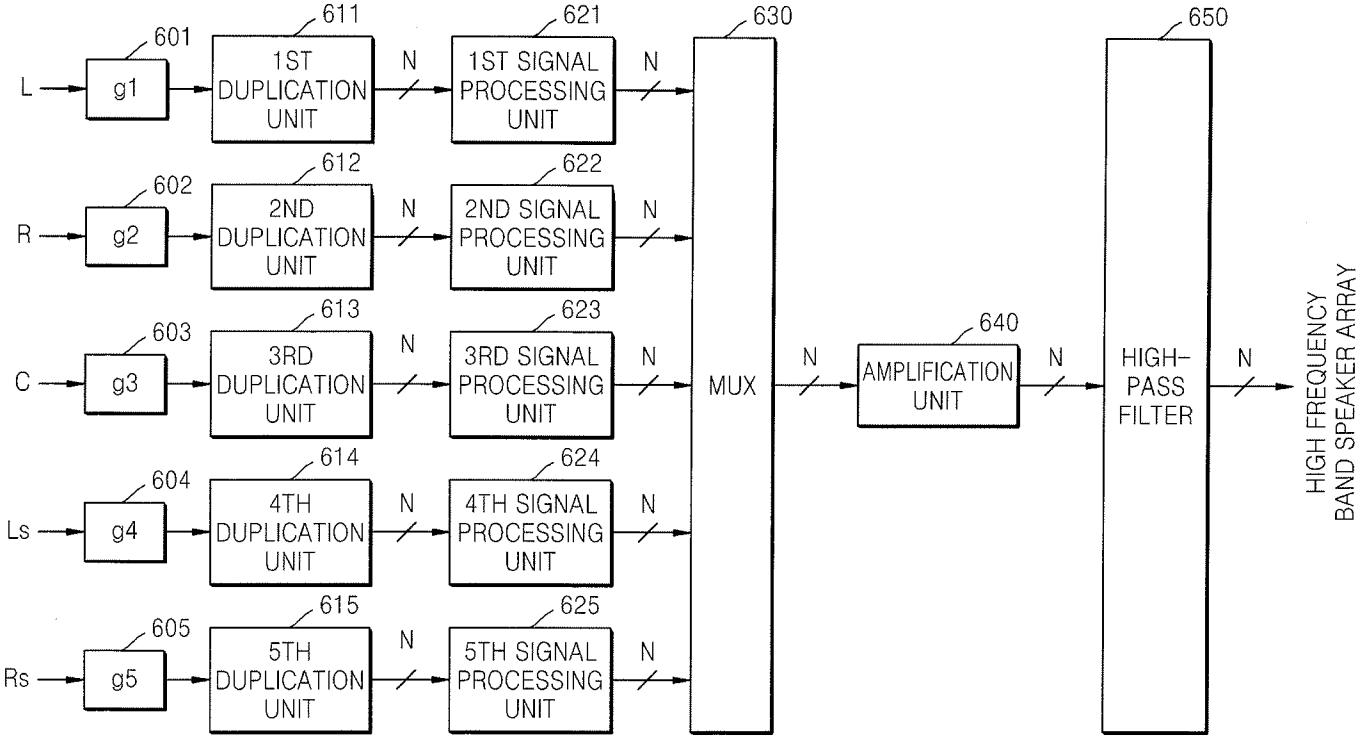
FIG. 6 is a detailed diagram of a steering processing unit illustrated in FIG. 4 according to an embodiment of the present general inventive concept.

FIG. 6 is a detailed diagram of the steering processing unit 400 illustrated in FIG. 4 according to an embodiment of the present general inventive concept.

First through fifth gain adjustment units 601 through 605 respectively adjust the gains of the signals of the front left channel (L), the front right channel (R), the center channel (C), the left surround channel (Ls), and the right surround channel (Rs) with gain values (g1 through g5). In another embodiment, if the signals of only the front left channel (L) and the left surround channel (Ls) are desired to be reproduced from the first high frequency band speaker array group 422, the gain values of the first through fifth gain adjustment units 601 through 605 may be combined and the signals of the channels other than the left channel (L) and the left surround channel (Ls) may be canceled.

In FIG. 6, the first through fifth duplication units 611 through 615 generate the same number of copies of each of the signals of the front left channel (L), the front right channel (R), the center channel (C), the left surround channel (Ls), and the right surround channel (Rs), which are gain-adjusted in the first through fifth gain adjustment units 601 through 605, as the number of speakers in each speaker array group. For example, if it is assumed that the number of speakers in the first high frequency band speaker array group 422 is N, each of the signals of the front left channel (L), the front right channel (R), the center channel (C), the left surround channel (Ls), and the right surround channel (Rs) are copied to N channel signals ($L_1$-$L_n$, $R_1$-$R_n$, $C_1$-$C_n$, $Ls_1$-$Ls_n$, $Rs_1$-$Rs_n$, respectively).

First through fifth signal processing units 621 through 625 amplify with gain values to suit the steering values of each channel, or delay with preset delay values to suit the steering values of each channel. The N-channel signals ($L_1$-$L_n$, $R_1$-$R_n$, $C_1$-$C_n$, $Ls_1$-$Ls_n$, $Rs_1$-$Rs_n$) are copied in each of the front left channel (L), the front right channel (R), the center channel (C), the left surround channel (Ls), and the right surround channel (Rs) in the first through fifth duplication units 611 through 615, respectively. For example, the first signal processing unit 621 sequentially amplifies the N-channel signals ($L_1$-$L_n$) copied in the first duplication unit 611 with different gains to suit preset steering angles, or sequentially delays the N-channel signals ($L_1$-$L_n$) with different delay values to suit preset steering angles. Accordingly, the first through fifth signal processing units 621 through 625 sequentially generate signals with predetermined delays and gains, thereby providing direction for the signals. In this case, the twisting angles are arbitrarily adjusted according to the amount of delay.

In FIG. 6, a multiplexer (MUX) 630 multiplexes the channel signals ($L_1$-$L_n$, $R_1$-$R_n$, $C_1$-$C_n$, $Ls_1$-$Ls_n$, $Rs_1$-$Rs_n$) processed by the first through fifth signal processing units 621 through 625, outputting the result as N-channel PCM signals. For example, if it is assumed that the number of speakers in a speaker array is N, the multiplexed signal can be expressed as $S_1+S_2+S_3+\ldots+S_n$, where $S_n=L_n+R_n+C_n+SL_n+SR_n$.

An amplification unit 640 adjusts the gain of each signal of the N channels multiplexed by the multiplexer 630, thereby giving the signals sharper directivity. The amplification unit 640 may apply a window for forming a beam to the multiplexed N-channel signals.

A high-pass filter 650 provides high-pass-filtering to the N-channel signals output from the amplification unit 640 to suit the characteristics of each speaker array. Accordingly, the high-pass-filtered N-channel signals are input to the respective speakers of a high frequency band speaker array.

Figure 7:
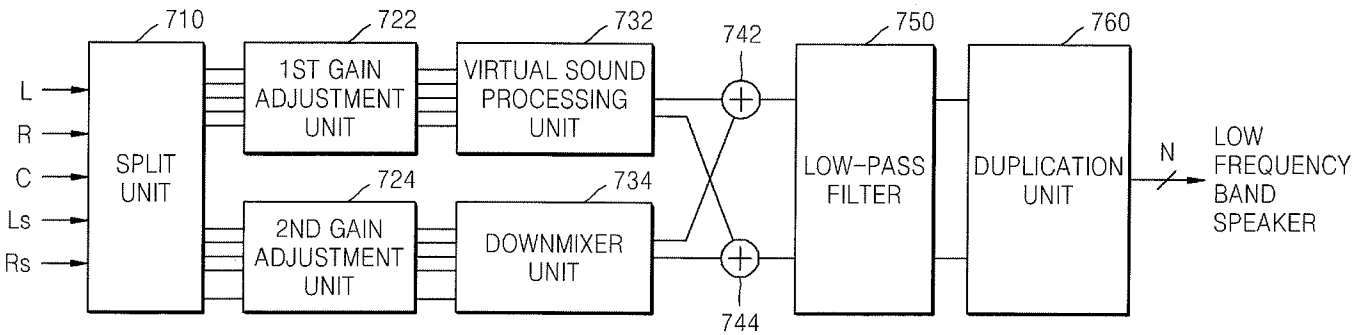
FIG. 7 is a diagram illustrating an audio processing unit illustrated in FIG. 4 according to an embodiment of the present general inventive concept.

FIG. 7 is a diagram illustrating the audio processing unit 440 illustrated in FIG. 4 according to an embodiment of the present general inventive concept.

In FIG. 7, a split unit 710 duplicates input 5-channel PCM signals, thereby separating the signals into two groups of 5-channel signals (5 channels+5 channels). A first gain adjustment unit 722 adjusts the gains of one group of channel signals separated by the split unit 710. A second gain adjustment unit 724 adjusts the gains of the other group of channel signals separated by the split unit 710.

FIG. 7 includes a downmixer unit 734 that downmixes the other group of the channel signals separated in the split unit 710, thereby generating 2-channel signals. A first addition unit 742 adds a first channel signal from the virtual sound processing unit 732 to a first channel signal from the downmixer unit 734. A second addition unit 744 adds a second channel signal from the virtual sound processing unit 732 to a second channel signal from the downmixer unit 734. In addition, a low-pass filter 750 low-pass-filters the 2-channel signals output from each of the first and second addition units 742 and 744 to suit the characteristics of each speaker array. Last, a duplication unit 760 copies the 2-channel signals filtered by the low-pass filter 750, thereby generating N-channel signals to be output to left and right low frequency band speakers in each speaker array group.

Figure 8:
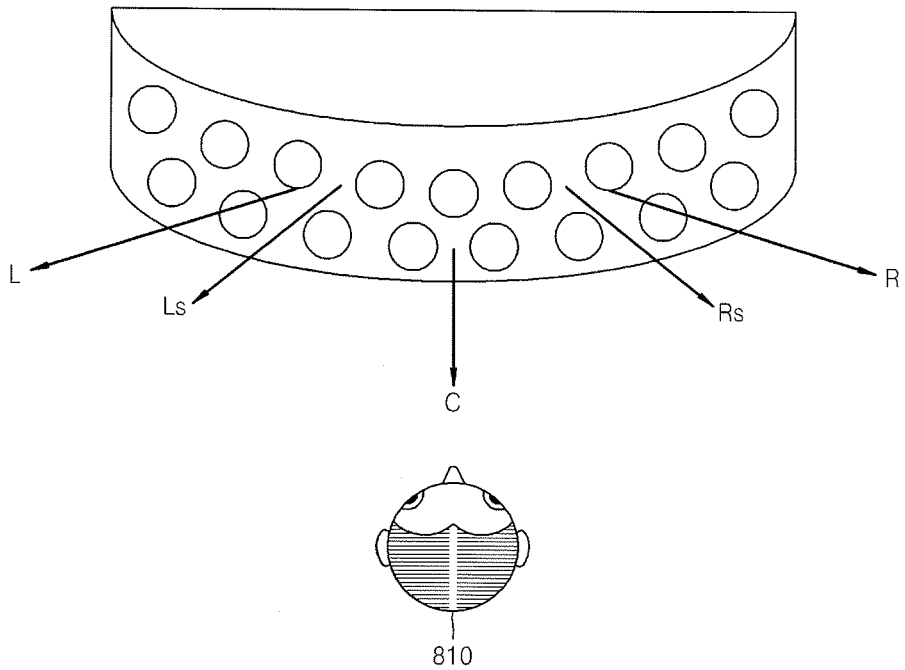
FIG. 8 is a diagram illustrating a curved surface speaker array in a front surround system according to an embodiment of the present general inventive concept.

FIG. 8 is a diagram illustrating a curved surface speaker array in a front surround system according to an embodiment of the present general inventive concept.

Referring to FIG. 8, the front surround system does not use a plurality of discontinuous plane arrays as illustrated in FIGS. 2 and 3, but rather uses a curved surface speaker array capable of continuously reducing steering angles. In this case, one or more speaker array groups are arranged on different positions on the curved surface.

Figure 9:
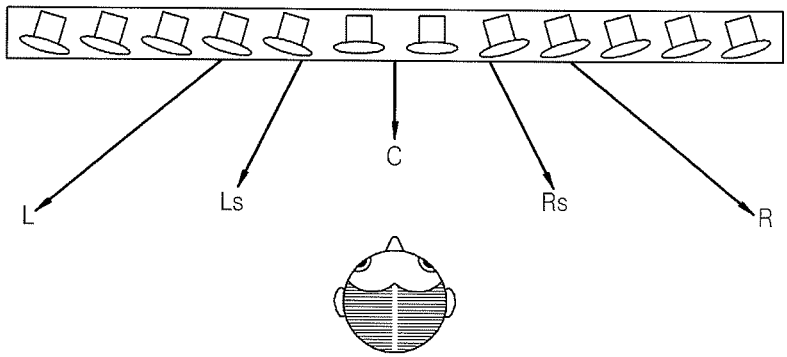
FIGS. 9 and 10 are diagrams illustrating different arrangements of speaker arrays in a front surround system according to embodiments of the present general inventive concept.
Figure 10:
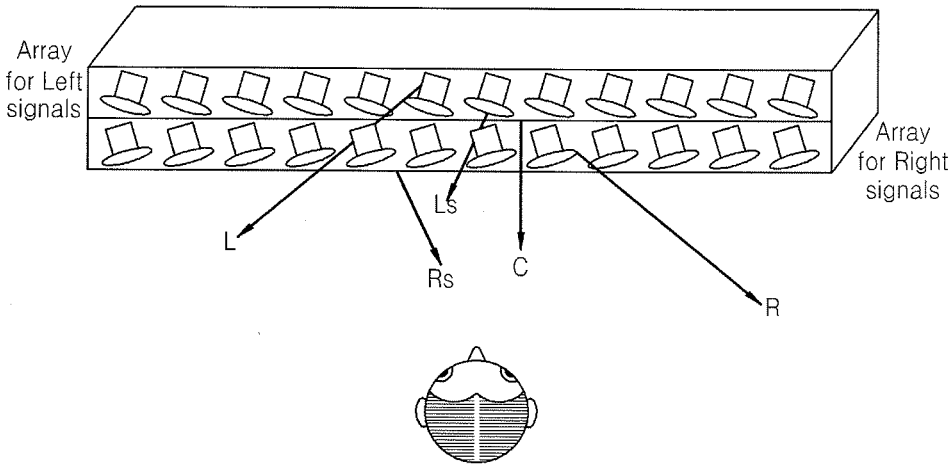

FIGS. 9 and 10 are diagrams illustrating different arrangements of speaker arrays in a front surround system according to embodiments of the present general inventive concept.

The speaker array structures as illustrated in FIGS. 9 and 10 can maintain a thin shape such as a flat panel TV, while reducing the steering angle of each channel.

Referring to FIG. 9, units (speakers) at the same height are divided into two groups. The units on the left are twisted progressively to the left, and the units on the right are twisted progressively to the right, thereby reducing the steering angles. That is, each speaker array group is twisted in a different direction.

Referring to FIG. 10, if units at one height are twisted in the same direction, and units at a different height are twisted in a direction that is different from the units at the other height, then the steering angles can be reduced and a wider speaker arrangement can be implemented. For example, a unit array on the top at one height may reproduce left channel signals (L, Ls) and a unit array on the bottom at a height different from the top unit array may reproduce right channel signals (R, Rs).

According to the present general inventive concept as described above, the quality of beams can be improved by reducing the steering angles of sound beams by using two or more discontinuous plane speaker arrays, or one or more curved surface speaker arrays, or a speaker array in which the steering direction of the respective speaker units is different from the speaker array surface direction. In other words, the speaker array improved according to the present invention uses a smaller steering angle (for example, 30 degrees), thereby forming sharper and more accurate beams and allowing listeners to experience an improved stereo effect.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The present general inventive concept can also be embodied as computer readable code on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

What is claimed is:

1. A front surround sound reproduction system in an audio reproduction apparatus to produce multi-channel audio signals by using a plurality of speakers, the system comprising:

a signal distribution unit to duplicate a multi-channel audio signal and distribute the duplicated signals as one or more groups of multi-channel signals corresponding to one or more speaker array groups;

a steering processing unit to form sound beams with steering angles to suit each speaker array group, from the groups of multi-channel signals distributed by the signal distribution unit, according to steering values corresponding to steering angles preset for each speaker array group; and a speaker array unit having the one or more speaker array groups to reproduce the sound beams of each group formed by the steering processing unit, in the speaker array groups, each speaker array group disposed on a different plane and connected to each other at a predetermined angle, each plane and predetermined angle being configured so as to minimize respective steering angles of each speaker array group to output sound directly toward a listener.

2. The system of claim 1, wherein the signal distribution unit applies different amplification values to the multi-channel audio signals, to distribute the duplicated signals as one or more groups of multi-channel signals.

3. The system of claim 2, wherein the amplification values are determined according to the number of speakers in each speaker array group or angles of each speaker array group.

4. The system of claim 1, wherein the steering processing unit comprises:

a signal duplication unit to copy each of the distributed multi-channel signals to N-channel signals corresponding to the number of speakers of the corresponding speaker array group;

a signal processing unit to amplify the N-channel signals with an amplification value corresponding to a steering angle preset for each channel, or delaying with a delay value preset for each channel, the N-channel signals copied in each channel; and a multiplexer to multiplex the signals in each channel processed in the signal processing unit, to output the result as N-channel signals.

5. The system of claim 1, wherein each speaker array group is arranged in a different plane.

6. The system of claim 1, wherein each speaker array group is arranged at a different position on a curved surface.

7. The system of claim 1, wherein in the speaker array unit, speakers at one height are divided into a left group and a right group, and the left group speakers are twisted to the left and the right group speakers are twisted to the right.

8. The system of claim 1, the speaker array unit comprises a top speaker array group to reproduce a first channel signal, and a bottom speaker array group to reproduce a second channel signal, wherein the speakers of the top speaker array group are twisted in the same direction and the speakers of the bottom speaker array group are twisted in the same direction different from the top speaker array.

9. The system of claim 1, further comprising an audio processing unit to generate low frequency band speaker signals from another group of multi-channel signals distributed by the signal distribution unit, through virtual sound processing and downmixing.

10. The system of claim 9, wherein the audio processing unit comprises:

a split unit duplicating multi-channel signals, to separate the multi-channel signals into two groups of multi-channel signals;

a virtual sound processing unit to generate a virtual sound signal based on a head related transfer function from one group of multi-channel signals separated by the split unit;

a downmixer unit to downmix the other group of multi-channel signal separated in the split unit, to generate 2-channel signals; and a low-pass filter to low-pass-filter the virtual sound signal generated by the virtual sound processing unit and the signal generated in the downmixer unit, to provide the result to a low frequency band speaker.

11. A method of reproducing multi-channel audio signals in a front surround system by using a plurality of speakers, the method comprising:

duplicating a multi-channel audio signal and distributing the duplicated signals as one or more groups of multi-channel signals corresponding to one or more speaker array groups;

forming sound beams with steering angles to suit each speaker array group, from the groups of multi-channel signals, according to steering values corresponding to steering angles preset for each speaker array group; and reproducing the sound beams of each group in the speaker array groups, each speaker array group being disposed on a different plane and connected to each other at a predetermined angle, each plane and predetermined angle being configured so as to minimize respective steering angles of each speaker array group to output sound directly toward a listener.

12. The method of claim 11, further comprising generating low frequency band signals for a low frequency band speaker from another distributed group of multi-channel signals through virtual sound processing and downmixing.

13. The method of claim 11, wherein forming of sound beams comprises:

copying each of the distributed multi-channel signals to N-channel signals corresponding to the number of speakers of the corresponding speaker array group;

amplifying with an amplification value corresponding to a steering angle preset for each channel, or delaying with a delay value preset for each channel, the N-channel signals copied in each channel; and multiplexing the processed signals in each channel, thereby outputting the result as N-channel signals.

14. A surround sound reproduction system, the system comprising:

a first speaker array having a plurality of first speakers arranged on a first plane to correspond to a plurality of first channel signals, a second speaker array having a plurality of second speakers, arranged on a second plane which is at an angle with respect to the first plane, to correspond to a plurality of second channel signals; and a steering processing unit to form sound beams with steering angles to suit the first speaker array and the second speaker array, respectively, according to steering values corresponding to steering angles preset for each of the first speaker array and the second speaker array, wherein the first speaker array and the second speaker array are disposed on different planes and connected to each other at a predetermined angle, each plane and predetermined angle being configured so as to minimize respective steering angles of the first and second speaker arrays to output sound directly toward a listener.

15. The system of claim 14, further comprising:

a center speaker array having a plurality of center speakers arranged near a boundary of the first plane and the second plane, to correspond to a plurality of third channel signals.

16. The system of claim 15, wherein the center speaker array having the plurality of center speakers is arranged on a third plane which is at an angle with respect to the first plane and the second plane.

17. The system of claim 14, further comprising:

a plurality of speaker arrays each having a plurality of speakers arranged at a boundary of the first plane and the second plane, to correspond to a plurality of further channel signals.

18. The system of claim 17, wherein the plurality of speaker arrays each having a plurality of speakers are arranged at an angle to the first plane or the second plane.

19. A surround sound reproduction system, the system comprising:

a steering processing unit to process a plurality of first channel signals having a first steering angle and a plurality of second channel signals having a second steering angle, to correspond to a first speaker array having a first plurality of speakers and a second speaker array having a second plurality of speakers, according to preset steering values corresponding to the first steering angle and the second steering angle, the first speaker array and second speaker array being disposed on different planes and connected to each other at a predetermined angle, each plane and predetermined angle being configured so as to minimize respective steering angles of the first and second speaker arrays to output sound directly toward a listener.

20. The system of claim 19, the system further comprising:

a signal distribution unit to duplicate a plurality of channel signals to distribute the duplicated channel signals, the plurality of channel signals to include the first channel signals and the second channel signals.

21. The system of claim 20, wherein the signal distribution unit applies different factors to the plurality of channel signals, to distribute the duplicated channel signals.

22. The system of claim 21, wherein the factors are determined by considering the number of speakers in each speaker array or angles of each speaker array.

23. The system of claim 19, the system further comprising:

an audio processing unit to process a plurality of third channel signals having a third steering angle, to correspond to third speaker array having a third plurality of speakers.

24. A surround sound reproduction system, the system comprising:

a first speaker array having a plurality of first speakers arranged on a first plane to correspond to a plurality of first channel signals, and a second speaker array having a plurality of second speakers, arranged on a second plane which is disposed at a predetermined angle with respect to the first plane, to correspond to a plurality of second channel signals, the second speaker array connected to the first speaker array at the predetermined angle, the first and second planes and the predetermined angle being configured so as to minimize respective steering angles of the first and second speaker arrays to output sound directly toward a listener;

a steering processing unit to process the plurality of first channel signals having a first steering angle and the plurality of second channel signals having a second steering angle according to steering values corresponding to the first steering angle and the second steering angle preset for the first speaker array and the second speaker array.

25. The system of claim 24, the system further comprising:

a center speaker array having a plurality of center speakers arranged near a boundary of the first plane and the second plane, to correspond to a plurality of third channel signals having a third steering angle.

26. The system of claim 25, wherein the center speaker array having the plurality of center speakers is arranged on a third plane which is at an angle with respect to the first plane and the second plane.

27. The system of claim 24, further comprising:

a plurality of speaker arrays each having a plurality of speakers arranged at a boundary of the first plane and the second plane, to correspond to a plurality of further channel signals having a further steering angle.

28. The system of claim 27, wherein the plurality of speaker arrays each having a plurality of speakers are arranged at an angle to the first plane or the second plane.

* * * * *